United States Patent [19]

Hwang et al.

[11] 4,327,308

[45] Apr. 27, 1982

[54] SIMPLIFIED POWER SOURCE FOR FLUORESCENT LAMPS

[76] Inventors: Top-Ping Hwang; Chin-Liang Feng, both of 13F Wan-Chen Trade Bldg., No. 477 Tung-Hwa South Rd., Taipei, Taiwan

[21] Appl. No.: 206,678

[22] Filed: Nov. 13, 1980

[51] Int. Cl.[3] ..... H05B 41/29

[52] U.S. Cl. ..... 315/99; 315/101; 315/105; 315/219; 315/DIG. 7

[58] Field of Search ..... 315/99, 101, 105, 177, 315/209 R, 219, DIG. 7

[56] References Cited

U.S. PATENT DOCUMENTS 3,629,648 12/1971 Brown et al. ..... 315/99 X 3,882,354 5/1975 May ..... 315/101

4,008,414 2/1977 Agnew ..... 315/105 X 4,145,636 3/1979 Dol ..... 315/219 X

*Primary Examiner*—Eugene R. La Roche

*Attorney, Agent, or Firm*—Cushman, Darby & Cushman

[57] ABSTRACT

A simplified power source for fluorescent lamps is characterized as that the filaments of the fluorescent lamps are connected in series with the primary winding of a transformer, an oscillator circuit and the power source so that the oscillating current will exert high voltage across the primary winding to start and drive the fluorescent lamps and when the fluorescent lamps are removed from their sockets, the oscillator circuit will be opened to prevent from occurring high tension for safety measure.

4 Claims, 1 Drawing Figure

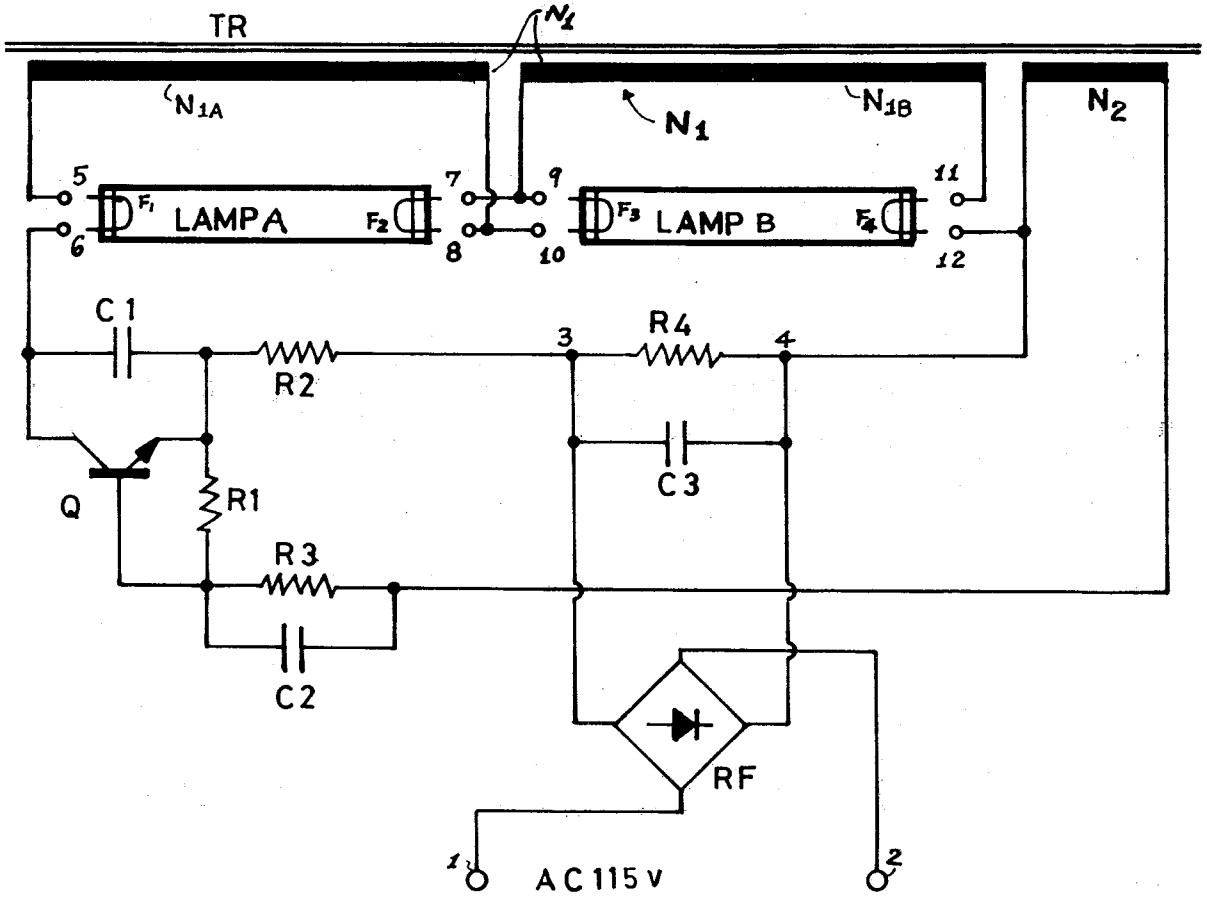
TR
N2
N1B
N1
N1
N1A
LAMP B
LAMP A
F1
F2
F3
F4
5
6
7
8
9
10
11
12
3
4
1
2
R4
C3
R2
R1
R3
C2
C1
Q
RF
AC 115 V

SIMPLIFIED POWER SOURCE FOR FLUORESCENT LAMPS

BACKGROUND OF THE INVENTION

The traditional fluorescent lamp comprises ballast and starter to start and drive the fluorescent lamp for its illumination. However, the structure of such conventional lamps seems complex. Their volume are large. They always cost higher power consumption and longer starting time.

Mr. John T. Pierce disclosed a "Power source for fluorescent lamps and the like" patented on June 10, 1975 (U.S. Pat. No. 3,889,153) to have improved light output, lower power consumption and high reliability for fluorescent lamps. However, the lamps are independently separated with the oscillator circuit so that several capacitors are provided to couple the electric energy from the oscillating power source with the lamps. Hence, several defects are found as follows:

1. Several windings of the transformer must be provided to induce voltage to pre-heat the lamp filaments to cause dissipation of electric energy.
2. Whenever removing either lamp from the circuit, an open circuit will occur so that the voltage across the transformer primary winding will be increased during the transistor turn-off portion of the inverter cycle. The increased voltage may cause overheating of the transistors or serious damage to the capacitors. Hence, a unique protective circuit must be further provided to increase the product cost.
3. As high voltage oscillation, the high tension will still exist on both sides of lamp sockets to cause danger when removing the lamp tube.
4. The oscillator circuit is independently separated with lamps so that it will consume energy in despite of the connection or disconnection of fluorescent lamps.

The present inventors have found the defects and researched to disclose the present simplified power source for fluorescent lamps.

SUMMARY OF THE INVENTION

The object of the present invention is to provide a power source wherein the filaments of fluorescent lamps are connected in series with the transformer winding so that the primary winding of the transformer will be connected to power source and oscillator circuit by means of the filaments and wherein the transformer winding itself will serve as an element of the oscillator circuit so as to simplify the whole circuit for lower construction cost and lower power consumption as well as to enhance safety as the circuit will be opened to stop oscillation and to prevent from occuring of high voltage when removing lamps from the circuit.

BRIEF DESCRIPTION OF THE DRAWING

The single FIGURE of the drawing is a circuit diagram of a power source for fluorescent lamps in accordance with the present invention.

DESCRIPTION OF THE PREFERRED EMBODIMENT

The single drawing shows one preferred embodiment of the present invention in that two lamps are inserted.

The power source circuit as shown in the figure comprises a high frequency transformer TR which is composed of two windings, N1 and N2. The primary winding N1 comprises two divided windings, N1A and N1B.

Primary winding N1 of transformer TR is also an oscillating winding in that one end of the devided winding N1A is connected through contact 5, filament F1 of LAMP A and contact 6 to the collector of transistor Q of the oscillator circuit and in that one end of another divided winding N1B is connected through contact 11, filament F4 of LAMP B and contact 12 to the positive electrode 4 of the power source.

Other ends of winding N1A and N1B are respectively connected to filaments F2 and F3 which are connected in parallel through contacts 7, 8, 9 and 10.

Feed-back winding N2 is connected by its one end to the positive electrode 4 of power source and connected by another end to the base of transistor Q through resistor R3 and capacitor C2 which are connected in parallel.

Transistor Q comprises a resistor R1 which is connected between the base and the emitter thereof and a capacitor C1 which is connected between collector and emitter thereof. The emitter is connected to negative electrode 3 through a resistor R2.

Input power source is led through terminals 1, 2 with alternative current of 115 volts. Such an AC current is recitified by rectifier RF and then connected with capacitor C3 and resistor R4 to develop one pair of DC terminals 3, 4.

When the circuit is supplied with power souce, the base of said transistor Q will get a positive bias to increase the current between the collector and the emitter thereof. The current passing through filaments to primary winding N1 of said transformer TR will be increased. However, the polarity of said feed-back winding N2 acts as negative feed-back so as to choke the increasing current and to exert oscillation. By using the time constants of C1, N1, R3, C2 and N2, a higher oscillating frequency will then be obtained which is more than 20 KHZ. As the high frequency oscillation, the voltage across two ends of said winding N1 will become so high. The filaments of LAMP A and LAMP B will accept the current supplied from N1 to heat the lamp tubes for rapid starting. The voltage of N1 will instantly light up the lamps.

When removing lamps from such a circuit, the power source of the primary winding N1 of transformer TR will be cut off so as to open the oscillator circuit and to eliminate the high voltage for a safer condition.

The present invention is greatly improved over the prior Pierce's patent as follows:

1 The present filaments of lamps constitute a current path which can be directly pre-heated so that the pre-heating winding and starting circuit of Pierce's patent can thus be omitted.
2. Filaments also constitute a current path of said oscillator circuit so that the circuit will be opened as removing lamps therefrom so as to save the open circuit protection in prior art.
3. Filaments are connected in series with said primary winding N1 so as to save any coupling means or components between the transformer winding and the lamps.

Therefore, the present invention has advantages of simpler construction, lower production cost, minor maintenance problem, lower power consumption and high safety reliability supperior to Pierce's patent.

The two lamps as shown in the figure may be substituted with a unique lamp and the transformer windings N1A and N1B may also be formed as a unique winding N1. Of course, the lamps may be modified to three sets or more in accordance with the present invention.

We claim:

1. A simplified power source for fluorescent lamps comprising an oscillator circuit and a transformer, said transformer comprising a primary winding and a feed-back winding, said oscillator circuit comprising a transistor and being characterized in that the collector of said transistor is connected to one end of said primary winding through a filament of the load lamp and in that the emitter of said transistor is connected through a resistor, one pair of direct-current terminals, one end of said feed-back winding and another filament of the load lamp to another end of said primary winding and in that another end of said feed-back winding is connected to the base of said transistor through a resistor and a capacitor both being connected in parallel.

2. A simplified power source according to claim 1 wherein said primary winding of said transformer also serves as an element of said oscillator circuit, and wherein both ends of said primary winding are connected in series with the filaments on both sides of load lamp so as to lead oscillating high voltage through filaments into lamp tube.

3. A simplified power source according to claim 1 wherein said lamp filaments are connected in series with said oscillator circuit so as to lead oscillating current therethrough for lighting a lamp.

4. A simplified power source according to claim 1 wherein said filaments of load lamp are respectively connected to said primary winding, said oscillator circuit and direct-current power source so that said oscillator circuit will be opened as removing lamp from the circuit so as to prevent from occuring high voltage or any possible danger.

* * * * *